US009446624B1

(12) United States Patent
Robertson

(10) Patent No.: US 9,446,624 B1
(45) Date of Patent: Sep. 20, 2016

(54) APPARATUS FOR CLEANING A PAINT ROLLER COVER BY SCRAPING OR BY SUBMERSION

(71) Applicant: Brian Robertson, Fort Wayne, IN (US)

(72) Inventor: Brian Robertson, Fort Wayne, IN (US)

( * ) Notice: Subject to any disclaimer, the term of this patent is extended or adjusted under 35 U.S.C. 154(b) by 0 days.

(21) Appl. No.: 14/680,563

(22) Filed: Apr. 7, 2015

(51) Int. Cl.

| | |
|---|---|
| ***B44D 3/00*** | (2006.01) |
| ***B05C 21/00*** | (2006.01) |
| ***A46B 17/06*** | (2006.01) |
| ***B05C 17/02*** | (2006.01) |

(52) U.S. Cl.
CPC ..... *B44D 3/006* (2013.01); *B05C 17/0245* (2013.01); *A46B 17/06* (2013.01); *B05C 21/00* (2013.01)

(58) Field of Classification Search
CPC .. A46B 17/06; B44D 3/006; B05C 17/0245; B05C 21/00
USPC ..... 15/236.03; 34/58; 134/900
See application file for complete search history.

(56) References Cited

U.S. PATENT DOCUMENTS

| | | | | |
|---|---|---|---|---|
| 2,711,748 | A * | 6/1955 | Barsness | B44D 3/006 134/149 |
| 2,938,368 | A | 5/1960 | Bixel | |
| 3,372,416 | A | 3/1968 | Katzell | |
| 3,436,264 | A | 4/1969 | Allen | |
| 3,925,908 | A * | 12/1975 | Dunn | B44D 3/006 134/149 |
| 4,263,055 | A | 4/1981 | Permar | |
| 5,185,938 | A | 2/1993 | Hutt | |
| 5,322,081 | A * | 6/1994 | Isaac | B44D 3/006 134/166 R |
| 5,539,948 | A | 7/1996 | Mcauley | |
| 5,784,798 | A | 7/1998 | Taylor | |
| 6,038,787 | A | 3/2000 | Dean | |
| 6,073,362 | A | 6/2000 | Dean | |
| 6,729,038 | B2 | 5/2004 | Lonier | |
| 6,818,071 | B2 | 11/2004 | King | |
| 7,967,497 | B2 | 6/2011 | Whitney | |
| 2003/0233763 | A1 | 12/2003 | Dean | |
| 2005/0039785 | A1 | 2/2005 | Knowles | |
| 2009/0293918 | A1 | 12/2009 | Wikman | |
| 2010/0252077 | A1 | 10/2010 | Muraske | |
| 2010/0258148 | A1 | 10/2010 | Anderson et al. | |
| 2012/0118333 | A1 | 5/2012 | Piccioni | |

FOREIGN PATENT DOCUMENTS

| | | | |
|---|---|---|---|
| CA | 1218253 | * | 2/1987 |
| CA | 2298024 | | 8/2001 |

OTHER PUBLICATIONS

Home Depot website, www.homedepot.com/p/Unbranded-Paint-Roller-Washer-Cleaner-and-Sprayer-Roller-Wizard-RW-100/204004386, published Dec. 31, 2013 on the World Wide Web, in English.

* cited by examiner

*Primary Examiner* — Mark Spisich
(74) *Attorney, Agent, or Firm* — Jeremy N. Gayed

(57) ABSTRACT

An improved apparatus for cleaning a paint roller by scraping or by submersion during rotation, comprising an attachment member connection to a base, said base further connected to a cylinder with an outer diameter approximately equal to the inner diameter of a paint roller frame, wherein said cylinder comprises a substantially solid surface interrupted by one or more longitudinal voids.

17 Claims, 2 Drawing Sheets

APPARATUS FOR CLEANING A PAINT ROLLER COVER BY SCRAPING OR BY SUBMERSION

CROSS-REFERENCES TO RELATED APPLICATIONS

Not Applicable

STATEMENT REGARDING FEDERALLY SPONSORED RESEARCH OR DEVELOPMENT

Not applicable

BACKGROUND

One common task required for the maintenance, repair, improvement, or beautification of surfaces, most notably walls, ceilings, floors, trim, or furniture surfaces, is painting. Those skilled in the art of painting use a variety of tools to apply paint to surfaces. One common tool known to the art for rapidly painting relatively flat surfaces is a paint roller. Generally, a paint roller consists of a roller cover and a roller frame. A roller cover is a cylindrical, relatively rigid tube open on one or both ends, comprising a substrate covered with a surface known to those skilled in the art as a nap. The nap is selected to absorb paint and then evenly apply it when rolled over a relatively flat surface. Common nap materials include foams, including rubber foams, and fabrics, including pile fabrics. Roller covers have two standard inner diameters, 1.5 inches and 1.75 inches, and are offered in a variety of different lengths. Common lengths include four inches, seven inches, nine inches, twelve inches, fourteen inches, and eighteen inches. A roller frame is a structure, typically wire, with a handle at one end and a tubular framework at the other end to fit inside of a roller cover, retain it by friction fit, and allow the roller cover to rotate and spin when in use. Typically, a roller frame will have an approximately ninety-degree bend between the handle end and the tubular end for ease of use. Roller frames generally include an integral or connected handle, and the tubular end is provided in diameters and lengths corresponding to the common diameters and lengths of roller covers. To use a paint roller, a painter slides the roller cover over a correspondingly-sized roller frame, wets the roller cover with paint, and, using the roller frame, rolls the roller cover along a surface to be painted.

During use of a paint roller, paint typically penetrates deeply into the nap. Although roller covers are commonly designed to be reusable, they are difficult to clean sufficiently to make them desirable for re-use. Roller covers are particularly difficult to clean thoroughly enough to allow their subsequent use to apply different colors, finishes, or styles of paint without undesirable mixing between the earlier- and later-applied products, or without dried residual paint degrading the consistency of application of new paint from the nap. Methods of cleaning a roller cover known to the art include scraping the nap along an edge, such as an edge of a paint can. Due to the roller cover's cylindrical shape, the roller cover must be rotated slightly after each section is scraped to enable cleaning of the entire nap. Once the entire nap has been scraped, it is typically still necessary to wash and scrub the roller cover to remove residual paint. The roller cover is then allowed to air dry. This known method of cleaning paint rollers has a number of disadvantages. Most notably, it is messy and unreasonably time consuming, particularly for a professional painter.

Another method of roller cover cleaning known to the art is to submerge the roller cover in a cleaning solution, typically water, and to move, spin, or agitate the roller cover while submerged to cause the removal of paint. This method of cleaning is, like scraping, unduly time consuming to perform by hand. Further, this method is typically not effective to remove paint from a roller cover without undue effort unless the scraping method described above is first used to remove excess paint from the nap.

Devices known to the art, such as hand-operated spinners, exist to aid with the rotation or agitation of a submerged roller cover for cleaning. These devices are relatively ineffective, however, and do not spin or agitate the roller cover at sufficient speeds to otter any meaningful advantage in time or effort compared to hand rotation. It is also known to the art to use a power drill and an adapter to spin a roller cover during submersion, such as by use of the apparatus described in U.S. Patent Publication No. 2010/0252077. The device described in the '077 Publication consists of a rod receivable by a motorized drill, the rod attached to a square tuning fork-shaped member, where the tines of the fork are flexible and are spaced to correspond to the interior diameter of a roller cover. A roller cover can be slid over the tines, forcing the tines to flex inward, and the apparatus can be attached to a drill to allow rapid rotation of the apparatus. This apparatus suffers a number of disadvantages. Notably, over time, the ability of this apparatus to securely retain a roller cover during use will degrade as the tines weaken from repeated flexion. Due, for example, to the design characteristic of the flexion of the tines, this apparatus inherently provides little to no support to the interior of a roller cover at the end opposite the base of the forks, and further provides little to no support to areas of the interior of the roller cover not directly adjacent to a time regardless of where located along the length of the roller cover. After repeated uses, this lack of support will likely cause degradation or damage to the unsupported portions of the roller cover, making this prior art apparatus unsuitable for use in connection with the scraping method of cleaning. Further, the design of this apparatus permits significant slippage of a roller cover when the device is in use, such slippage being particularly likely if the apparatus is used with a drill at high speed, and such slippage being likely to lead to abrasion or damage to the interior of the roller cover. Such slippage would further reduce the efficiency of the apparatus for cleaning using the submersion method. An improved apparatus is needed to assist with paint roller cleaning. Desirable traits for an improved apparatus would include increased durability in the face ore repeated use, and offering support to greater portions of the interior of a paint roller cover.

SUMMARY

The present invention is directed to an improved apparatus to assist with cleaning a roller cover by scraping or by submersion. Embodiments of the present invention offer greater durability in the face of repeated use, will hold a paint roller more securely during high-speed rotation, and will provide substantially greater support to the interior surface of a paint roller, than devices known to the prior art. Generally, embodiments of the present invention comprise an attachment member connected to a base, wherein the base is connected to a cylinder, the cylinder has an outer diameter approximately equal to the inner diameter of a paint roller cover, and the cylinder comprises a substantially solid surface interrupted by one or more longitudinal voids.

BRIEF DESCRIPTION OF THE DRAWINGS

These and other features, aspects, and advantages of the present invention will become better understood with regard to the following description and accompanying drawings, where.

DETAILED DESCRIPTION

Figure 1:
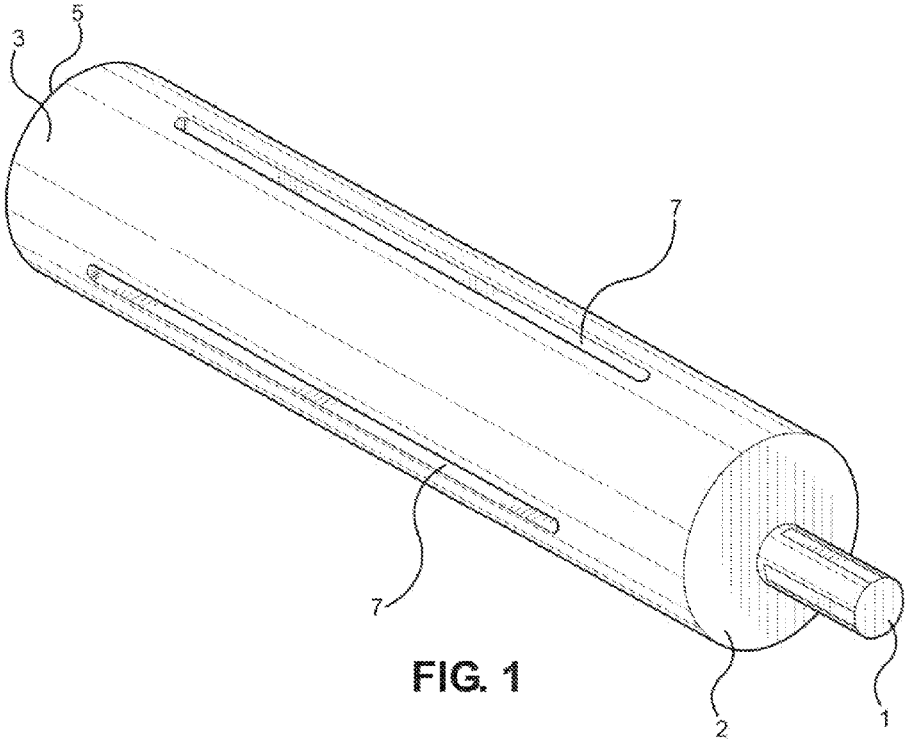
FIG. 1 shows a perspective view of a preferred embodiment of the present invention.

Embodiments of the present improved apparatus for cleaning a paint roller cover by scraping or immersion. The present invention provides a number of advantages compared to devices known to the prior art. Specifically, embodiments of the present invention provide an apparatus for securing and attaching a paint roller cover to a drill, permitting high-speed rotation of the roller cover without significant slippage, abrasion, or damage to the interior of the roller cover, allowing water or other fluid to reach both the interior and exterior of the roller cover during submersion, and affording substantial support to the interior of a roller cover, including, optionally, support along substantially all of the roller cover's length, such that the roller cover can be cleaned by either submersion or scraping with reduced risks of damage, abrasion, or degradation from lack of interior support.

In a preferred embodiment, the apparatus of the present invention comprises an attachment member (1) rigidly connected to a base (2), wherein the base (2) is connected to a tubular cylinder (3), the cylinder (3) comprises a substantially solid surface interrupted by at least one longitudinal void (7), and the cylinder further comprises a cylinder end (5). In a preferred embodiment, the apparatus of the present invention is made of a material that is relatively light, rigid, and corrosion resistant. Suitable preferred materials include metals and metal alloys, woods, laminate surfaces, and rigid plastics and polymers. Most preferably, the apparatus is made of aluminum.

Figure 2:
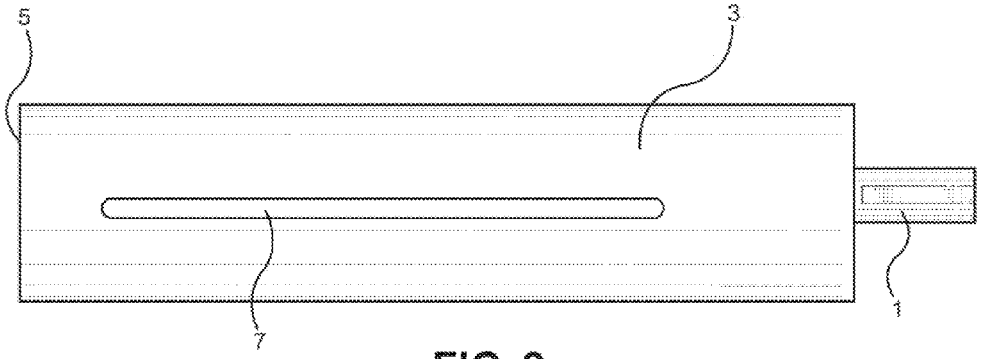
FIG. 2 shows a side view of a preferred embodiment of the present invention.

An attachment member (1) of the present invention is a shank configured to attach the apparatus to a tool providing rotation about the central longitudinal axis of the apparatus. In the preferred embodiment depicted in FIGS. 1-3, the attachment member (1) is a shank protruding substantially orthogonally from the base (2), with a shape, size, and profile suitable for insertion into the chuck of a handheld drill. As would be appreciated by one skilled in the art, a variety of shapes, sizes, and profiles may be used. For example, suitable profiles include round, square, rectangular, hexagonal, and octagonal. As shown in FIG. 1, in a preferred embodiment the attachment member (1) comprises a hex shank.

Figure 3:
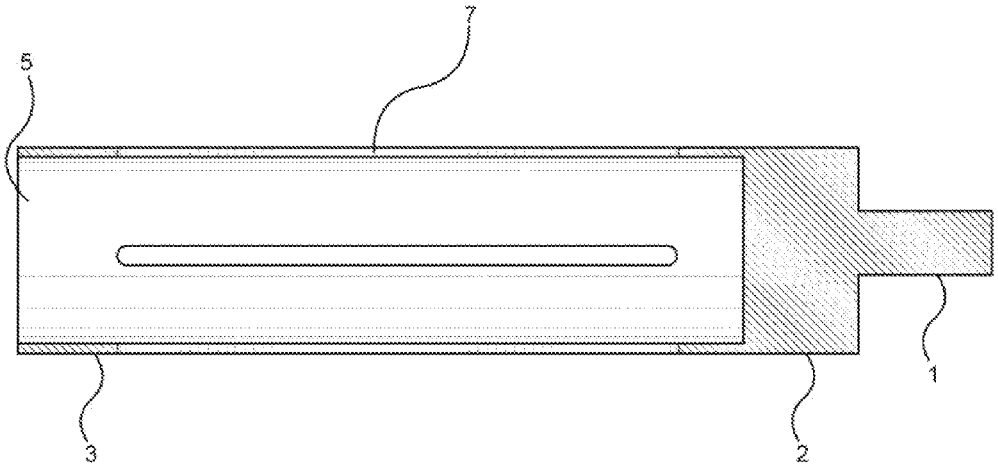
FIG. 3 shows a cross-sectional side view of a preferred embodiment of the present invention.

The base (2) of embodiments of the present invention comprises a platform, preferably substantially orthogonal to the attachment member (1), supporting the cylinder (3) and rigidly attached to both the attachment member (1) and to the cylinder (3). In a preferred embodiment, the attachment member (1), base (2), and cylinder (3) are integral to each other. As would be appreciated by one skilled in the art, however, the base (2) may be integral to only one of the attachment member (1) or cylinder (3), or may comprise a component separate from, but connected to, one or more of the attachment member (1) and cylinder (3). The base (2) may be a solid platform, or may be an interrupted platform comprising multiple bars, struts, or supports. The base (2) may be any size or shape suitable to support a cylinder (3) with an outer diameter substantially equal to the inner diameter of a paint roller. In a preferred embodiment, as shown in FIG. 3, the base (2) comprises a generally disc-shaped platform integral to both the attachment member (1) and the cylinder (3).

A cylinder (3) of the present invention comprises a substantially hollow tube connected to the base (2). A cylinder (3) may comprise a smooth outer surface, or it may comprise a roughened outer surface. A cylinder (3) of embodiments of the present invention preferably has an outer diameter approximately equal to the inner diameters of commercially available roller covers. Preferred cylinder outer diameter sizes are approximately 1.5 inches and approximately 1.75 inches. A cylinder (3) according to embodiments of the present invention may be of any length suitable to accommodate the length of a commercially available roller cover. Although the cylinder may be of any length within the spirit and teaching of the present invention, preferred lengths include one or more of: approximately four inches, approximately seven inches, approximately nine inches, approximately twelve inches, approximately fourteen inches, and approximately eighteen inches. In a most preferred embodiment, the cylinder (3) has a length of approximately six inches. As would be appreciated by one skilled in the art, a cylinder (3) can be sized to accommodate a specific length of paint roller cover or, alternatively, a cylinder (3) of any length, particularly one of the preferred lengths noted above, can be used in conjunction with a paint roller cover of any common length. For example, an embodiment of the present invention with a cylinder (3) of approximately seven inches may be used in conjunction with a seven-inch (or smaller) paint roller cover, in which case the apparatus would support the interior of the paint roller cover along the substantial entirety of both its circumference and length. Alternatively, that same embodiment of the apparatus could be used to support a paint roller cover longer than seven inches, in which case the apparatus would support the interior of the paint roller cover along the substantial entirety of its circumference for a portion of its length.

A cylinder (3) according to the present invention may have the same outer diameter at all points along its length. Preferably, however, the cylinder (3) is tapered such that its outer diameter is narrower at the portion of the cylinder immediately adjacent to the cylinder end (5) than it is at the portion of the cylinder immediately adjacent to the base (2). Such a taper permits a roller cover to slide onto the cylinder (3) without harmfully bending, crushing, or deflecting the substrate of the roller cover, while also allowing a sufficiently tight fit between the cylinder (3) and the roller cover to secure the roller cover and prevent undue slippage during high speed rotation. In a preferred embodiment, the taper is slight, such that while the roller cover is secured to the apparatus more tightly near the base (2) than it is near the cylinder end (5), the entire length of the cylinder (3) substantially supports the interior of the roller cover. In a most preferred embodiment, the taper is continuous and the difference between the outer diameter of the portion of the cylinder immediately adjacent to the cylinder end (5) and the portion of the cylinder immediately adjacent to the base (2) is equal to less than approximately 0.25 inches.

The cylinder (3) comprises one or more voids (7). A void (7) preferably comprises a longitudinal slot piercing the cylinder surface (3) and allowing fluid communication between the interior and exterior of the cylinder (3). Voids (7) permit water or other cleaning fluids that enter the interior of the cylinder to communicate with the interior of a roller cover attached to the apparatus. Optionally, a void (7) may comprise a regularly or irregularly shaped aperture piercing the cylinder surface (3) allowing fluid communication between the interior and exterior of the cylinder (3). An apparatus according to the present invention comprises at least one void (7). Preferred embodiments of the present invention comprise multiple voids. The number and size of the voids is limited primarily by the requirement that the cylinder surface remain sufficiently rigid to substantially structurally support the interior of a roller cover along substantially all of the cylinder's length and circumference. Most preferably, the present invention comprises four longitudinal slot voids equidistantly spaced along the surface of the cylinder (3). Optionally, voids may be configured to assist with retention of the roller cover by the apparatus, and specifically may comprise one or more exterior edges that are sharp, profiled, raised, roughened, or otherwise configured to assist with ensuring that during use the rotation of the apparatus is imparted to the roller cover without undue slippage of the roller cover with respect to the apparatus.

The apparatus further comprises a cylinder end (5) opposite the attachment means (1). The cylinder end may comprise a solid cap, may comprise a cap with one or more through-holes, or may comprise one or more struts or supports wholly or partially spanning the endmost open interior portion of the cylinder (3). In a preferred embodiment, as shown in FIG. 3, the cylinder end (5) comprises an opening defined by the cylinder walls. The cylinder end (5) in preferred embodiments permits water or other cleaning fluid to enter the interior of the cylinder, where such water or other cleaning fluid may contact the interior of a roller cover through the one or more voids.

An apparatus according to the present invention may be used, in conjunction with a power drill and a roller cover, to clean and dry a roller cover through a submersion method. Submersion cleaning through use of this apparatus is accomplished by attaching the attaching member of the apparatus to a power drill, aligning the interior central bore of a roller cover with a correspondingly-sized cylinder of the present invention, sliding the roller cover over the cylinder a desired distance, submerging the roller cover and apparatus into water or other cleaning fluid, and actuating the power drill to rotate the roller cover at relatively high speed. Water or other cleaning fluid will contact and clean the nap directly and will also contact and clean the interior of the roller cover through the one or more voids. One or more submersions in one or more containers of water or other fluid may be employed to clean a roller cover. When the roller cover has reached the desired degree of cleanliness, the apparatus may be removed from submersion and the drill again activated. In open air, the relatively high speed rotation of the apparatus will squeeze water out of the roller cover through centrifugal force, drying it.

Because of the substantial support provided to the interior of a roller cover along the entire length and circumference of the cylinder, an apparatus according to embodiments of the present invention may also be used to assist with cleaning and drying a roller cover through a scraping method. Scrape cleaning through use of this apparatus is accomplished by attaching the attaching member of the apparatus to a power drill, aligning the interior central bore of a roller cover with a correspondingly-sized cylinder of the present invention, sliding the roller cover over the cylinder a desired distance, pressing the roller cover nap against a suitable edge, such as the edge of a board, a step, a rail, or a tray, and actuating the power drill to rotate the roller cover at relatively high speed, scraping the nap against the edge. Paint is squeezed out of the nap by centrifugal force, and is separately forced out of the nap by high-speed scraping between the nap and the selected edge. Because of the substantial support provided along substantially the entirety of the circumference and length of the cylinder, this method may be used without undue risk of damage or degradation to the roller cover during scraping. Alternately, as would be appreciated by one skilled in the art, a roller cover may be pre-cleaned or cleaned by mounting a roller cover to the apparatus, attaching the apparatus to a power drill, and actuating the drill to cause paint to be squeezed from the roller cover through centrifugal force alone. After scraping, a roller cover may optionally be further cleaned by submersion.

Although the present invention has been described in considerable detail with reference to certain preferred versions thereof, other versions are possible. For example, materials, shapes, sized, or configurations other than those described in detail herein may be used for the versions of this invention. Therefore, the spirit and scope of the claims should not be limited to the description of the preferred versions described herein.

What is claimed is:

1. An apparatus for cleaning a roller cover by scraping or by submersion, said apparatus comprising an attachment member rigidly connected to a base, wherein said base is connected to a rigid tubular cylinder with an outer diameter approximately equal to the inner diameter of a roller cover, wherein said cylinder comprises a tube and at least one elongate void through a wall of said tube, said void being defined by opposed edges of said tube with said edges defining the void being the same radial distance from the center of the tube, the space between said edges defining the void being open such that the surfaces immediately adjacent said edges defining the void are adapted to directly engage the inner surface of the roller cover, and wherein said cylinder further comprises a cylinder end.

2. The apparatus of claim 1, wherein said at least one void provides fluid communication between the interior and exterior of said cylinder and comprises an aperture or a longitudinal slot.

3. The apparatus of claim 2, wherein said cylinder has an outer diameter equal to approximately 1.5 inches or approximately 1.75 inches.

4. The apparatus of claim 2, wherein said cylinder is tapered such that the outer diameter of the portion of said cylinder adjacent to said base is wider than the outer diameter of the portion of said cylinder adjacent to said cylinder end.

5. The apparatus of claim 4, wherein said taper is substantially continuous along the length of said cylinder.

6. The apparatus of claim 5, wherein said cylinder supports the inner surface of a roller cover along substantially the entire circumference and length of said cylinder.

7. The apparatus of claim 6, wherein the difference between the outer diameter of the portion of said cylinder immediately adjacent to said cylinder end and the outer diameter of the portion of said cylinder immediately adjacent to said base is equal to or less than approximately 0.25 inches.

8. The apparatus of claim 6, wherein said cylinder end is at least partially open.

9. The apparatus of claim 8, wherein said cylinder end comprises an opening defined by the walls of said cylinder.

10. The apparatus of claim 8, wherein said attachment member comprises a shank with a profile suitable for connection to a drill chuck.

11. The apparatus of claim 10, wherein said attachment member comprises a hex shank.

12. The apparatus of claim 11, wherein said cylinder has a length approximately equal to a length of a roller cover.

13. The apparatus of claim 11, wherein said cylinder has a length of approximately six inches.

14. The apparatus of claim 11, wherein said cylinder has a length selected from the group consisting of: approximately four inches, approximately seven inches, approximately nine inches, approximately twelve inches, approximately fourteen inches, and approximately eighteen inches.

15. The apparatus of claim 11, wherein said cylinder comprises at least two voids, and each of said voids comprises a longitudinal slot.

16. The apparatus of claim 15, wherein said voids are equidistantly spaced around the circumference of said cylinder.

17. The apparatus of claim 16, wherein said cylinder comprises four voids.

* * * * *